US007843307B2

(12) United States Patent
Yoshikawa

(10) Patent No.: US 7,843,307 B2
(45) Date of Patent: Nov. 30, 2010

(54) THERMAL FUSE EMPLOYING THERMOSENSITIVE PELLET

(75) Inventor: Tokihiro Yoshikawa, Koka (JP)

(73) Assignee: NEC SCHOTT Components Corporation, Koka-shi (JP)

( * ) Notice: Subject to any disclaimer, the term of this patent is extended or adjusted under 35 U.S.C. 154(b) by 70 days.

(21) Appl. No.: 12/284,936

(22) Filed: Sep. 23, 2008

(65) Prior Publication Data

US 2009/0091417 A1 Apr. 9, 2009

(30) Foreign Application Priority Data

Oct. 5, 2007 (JP) ..... 2007-261558

(51) Int. Cl.
*H01H 85/06* (2006.01)
*H01H 85/055* (2006.01)

(52) U.S. Cl. ..... 337/416; 337/401; 337/407; 337/298

(58) Field of Classification Search ..... 337/298, 337/401, 407, 416; 29/623
See application file for complete search history.

(56) References Cited

U.S. PATENT DOCUMENTS 3,180,958 A 4/1965 Merrill
3,281,559 A 10/1966 Ebensteiner
3,409,448 A * 11/1968 Levine et al. ..... 106/10
3,519,972 A * 7/1970 Merrill ..... 337/407
3,529,270 A 9/1970 Kozacka
3,727,164 A 4/1973 Cartier et al.
3,778,742 A 12/1973 Merrill
3,781,737 A 12/1973 Henry
3,815,071 A 6/1974 Sleeter
3,930,215 A 12/1975 Senor
4,001,754 A 1/1977 Plasko
4,060,787 A * 11/1977 Budnik ..... 337/408
4,065,741 A 12/1977 Sakamoto et al.
4,068,204 A 1/1978 Iwanari et al.
4,084,147 A 4/1978 Mlyniec et al.
4,160,968 A 7/1979 Saini
4,167,724 A 9/1979 McCaughna (Continued)

FOREIGN PATENT DOCUMENTS

CN 1037720 12/1989

(Continued)

*Primary Examiner*—Anatoly Vortman
(74) *Attorney, Agent, or Firm*—W. F. Fasse; W. G. Fasse

(57) ABSTRACT

A thermal fuse employing a thermosensitive pellet is provided, which exhibits stabilized characteristics in a low operating temperature region. The thermal fuse includes at least a switching movable member, a thermosensitive pellet member, a pair of leads having a first lead portion and a second lead portion, and a metal casing. The thermosensitive pellet member contains a polyolefin wax. The thermosensitive pellet member is housed in the metal casing to which the pair of leads are attached. The switching movable member is operated by deformation associated with softening or melting of the thermosensitive pellet member, to attain a cut-off state between the pair of leads. The thermal fuse employing a thermosensitive pellet is suitable for an operating temperature of 50 to 180° C. Furthermore, in the thermosensitive pellet member the polyolefin wax is mixed with a thermoplastic resin as appropriate, to thereby provide a thermal fuse employing a thermosensitive pellet which increases the response speed while maintaining the operating temperature with high accuracy.

14 Claims, 1 Drawing Sheet

U.S. PATENT DOCUMENTS

| | | | | |
|---|---|---|---|---|
| 4,184,139 | A | 1/1980 | Hara | |
| 4,189,697 | A | 2/1980 | Hara | |
| 4,246,561 | A | 1/1981 | McVey | |
| 4,246,564 | A * | 1/1981 | Olson et al. | 337/409 |
| 4,259,656 | A | 3/1981 | Smith | |
| 4,276,531 | A | 6/1981 | Davis | |
| 4,276,532 | A | 6/1981 | Aoki | |
| 4,281,309 | A | 7/1981 | Olson | |
| 4,286,248 | A | 8/1981 | Hara | |
| 4,297,669 | A | 10/1981 | Gale | |
| 4,322,705 | A | 3/1982 | Hara | |
| 4,384,267 | A | 5/1983 | Aoki | |
| 4,401,965 | A | 8/1983 | Backlund et al. | |
| 4,480,247 | A | 10/1984 | Hara | |
| 4,514,718 | A | 4/1985 | Birx | |
| 4,529,957 | A | 7/1985 | Hara | |
| 4,630,023 | A | 12/1986 | Gawron et al. | |
| 4,808,960 | A | 2/1989 | Nixon | |
| 4,808,965 | A | 2/1989 | Cenky | |
| 4,821,010 | A | 4/1989 | Plasko | |
| 4,825,187 | A * | 4/1989 | Cenky | 337/407 |
| 4,973,932 | A | 11/1990 | Krueger et al. | |
| 5,025,070 | A * | 6/1991 | Suzuki | 525/184 |
| 5,357,234 | A | 10/1994 | Pimpis et al. | |
| 5,473,303 | A | 12/1995 | Hohider | |
| 5,530,417 | A | 6/1996 | Hohider | |
| 5,532,030 | A | 7/1996 | Hirose et al. | |
| 5,612,663 | A | 3/1997 | Hollweck | |
| 5,825,277 | A | 10/1998 | Bishop et al. | |
| 6,407,189 | B1 * | 6/2002 | Herrmann | 526/160 |
| 6,440,492 | B1 | 8/2002 | Coran | |
| 6,673,257 | B1 | 1/2004 | Hudson | |
| 6,710,310 | B2 | 3/2004 | Hantz | |
| 6,724,292 | B2 | 4/2004 | Miyashita et al. | |
| 6,982,112 | B2 | 1/2006 | Coran | |
| 7,323,965 | B2 | 1/2008 | Yoshikawa | |
| 7,323,966 | B2 | 1/2008 | Yoshikawa | |
| 7,330,098 | B2 | 2/2008 | Yoshikawa | |
| 7,362,208 | B2 | 4/2008 | Yoshikawa et al. | |
| 2003/0112117 | A1 | 6/2003 | Miyashita et al. | |
| 2003/0220460 | A1 | 11/2003 | Merfeld | |
| 2005/0088272 | A1 | 4/2005 | Yoshikawa | |
| 2005/0179516 | A1 | 8/2005 | Yoshikawa | |
| 2006/0208845 | A1 | 9/2006 | Yoshikawa | |
| 2006/0232372 | A1 | 10/2006 | Yoshikawa | |
| 2009/0179729 | A1 | 7/2009 | Yoshikawa | |

FOREIGN PATENT DOCUMENTS

| | | |
|---|---|---|
| DE | 24 57 223 | 10/1975 |
| DE | 34 22 528 | 12/1985 |
| EP | 1 120 432 | 8/2001 |
| EP | 1 308 974 | 5/2003 |
| EP | 1 498 925 | 1/2005 |
| GB | 2 011 724 | 7/1979 |
| JP | 50-138354 | 11/1975 |
| JP | 51-145538 | 11/1976 |
| JP | 52-144046 | 12/1977 |
| JP | 57-094142 | 6/1982 |
| JP | 57-103647 | 6/1982 |
| JP | 57-140034 | 9/1982 |
| JP | 60-138819 | 7/1985 |
| JP | 62-246217 | 10/1987 |
| JP | 02-281525 | 11/1990 |
| JP | 05-135649 | 6/1993 |
| JP | 05-307925 | 11/1993 |
| JP | 06-012594 | 3/1994 |
| JP | 2551754 | 8/1996 |
| JP | 09-063441 | 3/1997 |
| JP | 09-282992 | 10/1997 |
| JP | 10-177833 | 6/1998 |
| JP | 11-111135 | 4/1999 |
| JP | 11-238440 | 8/1999 |
| JP | 2001-049092 | 2/2001 |
| JP | 2002-163966 | 6/2002 |
| JP | 2003-317589 | 11/2003 |
| JP | 2003-317590 | 11/2003 |
| JP | 2004-095212 | 3/2004 |
| JP | 2004-095524 | 3/2004 |
| JP | 2004-119255 | 4/2004 |
| JP | 2005-158681 | 6/2005 |
| JP | 2006-260926 | 9/2006 |
| KR | 1998-071949 | 10/1998 |
| KR | 2003-0042982 | 6/2003 |
| KR | 2004-0101534 | 12/2004 |

* cited by examiner

THERMAL FUSE EMPLOYING THERMOSENSITIVE PELLET

BACKGROUND OF THE INVENTION

1. Field of the Invention

The present invention relates to a thermal fuse selecting and using, as a thermosensitive material, a polyolefin wax typified by polyethylene and polypropylene, each of which are a thermoplastic wax.

2. Description of the Background Art

The thermal fuse employing a thermosensitive pellet using a non-conductive thermosensitive material (hereinafter simply referred to as a thermosensitive material) is a so-called irreversible type thermal switch which generally operates at a prescribed temperature at which the thermosensitive material formed into a pellet shape is softened and melted, to interrupt the current conducting path of equipment and an apparatus for protection thereof. It operates at a temperature (operating temperature) approximately determined by the composition of the thermosensitive material to be used. And a switching component such as a spring is selected to adjust the operating temperature. For example, the thermal fuse employing a thermosensitive pellet is configured such that the non-conductive thermosensitive material is pelletized and used in a metal casing having a lead attached at each end, in which a switching member including a spring member such as a compression spring and a slidable contacting conductor is housed in the predetermined position of the metal casing. The thermosensitive material to be pelletized is selected from a pure chemical substance alone, a thermoplastic resin material used alone or a thermoplastic resin composition. In this case, the thermosensitive pellet softens or melts at a prescribed operating temperature and the compression spring moves the contact of the movable conductor to thereby cause insulation between a pair of leads. The thermosensitive material of the thermosensitive pellet is pelletized by the prescribed forming process including granulation and tableting. A thermoplastic resin material is recently used as the thermosensitive material, which is characteristically advantageous because of an improvement concerning the adjustment of the operating temperature.

Japanese Patent Laying-Open Nos. 2003-317589, 2005-158681 and 2006-260926 (Patent Documents 1 to 3) disclose improved structures of a thermal fuse employing a thermosensitive pellet using a non-conductive thermoplastic resin material for a thermosensitive material in accordance with the proposal by the inventor of the present invention. These provide a method for solving some problems concerning the workability and operating characteristics in the case where the thermoplastic resin is used as a thermosensitive material. For example, these present selection of the resin material, means for adjusting the operating temperature, and appropriate means against the characteristic degradation associated with the change over time.

SUMMARY OF THE INVENTION

A thermal fuse employing a thermosensitive pellet is configured such that a non-conductive thermosensitive pellet is housed together with a compression spring and a movable conductor in a metal casing having a lead attached at each end, in which the thermosensitive pellet softens or melts at a prescribed operating temperature and the compression spring causes the contact of the movable conductor to be moved. However, the above-described thermal fuse employing a thermosensitive pellet using a thermoplastic resin for the thermosensitive pellet produces problems such as that the setting of the operating temperature in a relatively low temperature region is difficult and the actuation at the prescribed operating temperature requires a long period of time. It is conceivable to use a natural wax such as an animal-based shellac wax, a plant-based carnauba wax or a mineral-based paraffin wax, as a thermosensitive material in the low temperature region. However, these natural waxes each have a complicated melting peak and a wide range of the melting temperature, which leads to a shortcoming including the instability of the operating temperature. Furthermore, these natural waxes are difficult to be released from the mold in the pelletization process and are sticky when contacting a human hand during the operation, which causes handling problems.

An object of the present invention is, therefore, to provide a thermal fuse employing a thermosensitive pellet that uses a synthetic wax obtained by chemical synthesis instead of a naturally-derived wax. The synthetic wax is, as a thermoplastic wax, distinguished from a thermoplastic resin. In the present invention, the synthetic wax means that having a weight average molecular weight of 100,000 (Mw) or less measured by a gel permeation chromatography (GPC) method. The synthetic wax serves to solve the above-described problems and allows quick actuation and operation. Furthermore, the thermosensitive material including the synthetic wax exhibits excellent characteristics for balance of retentivity, hardness and toughness in terms of the mechanical physical properties, and excellent characteristics for workability and handleability. It is to be noted that the weight average molecular weight measured by the above-mentioned GPC method is a polystyrene reduced value and corresponds to that same value in this specification unless otherwise stated.

Another object of the present invention is to obtain a thermosensitive pellet member having high operation performance by selecting a polyolefin wax which is a thermoplastic wax for a thermosensitive substance, and mixing or adding a supplementary agent such as a thermoplastic resin, an antioxidant, a plasticizer and a filler as required. In this case, the weight average molecular weight of the wax is determined to set a prescribed operating temperature. It is to be noted that the polyolefin wax is used mixed with the same type of the polyolefin resin to allow facilitation of fine adjustment of the operating temperature and pelletization. For example, a thermal fuse employing a thermosensitive pellet can be provided which has less characteristic variation and allows the time for stabilization and actuation to be shortened, while the thermosensitive pellet is produced by the method such as the conventional injection molding and extrusion.

According to the present invention, a thermal fuse employing a thermosensitive pellet is provided in which a switching movable member and a thermosensitive pellet member containing a polyolefin wax are housed in a cylindrical casing to which a pair of leads are attached, and the switching movable member is operated by the deformation associated with softening or melting of the thermosensitive pellet member to attain a cut-off state between the leads. An antioxidant and the like are added to the above-described thermosensitive pellet member in which the operating temperature is set within a range of 50 to 180° C. and preferably 50 to 90° C. Furthermore, the polyolefin wax is selected from one type or two or more types of polyethylene, polypropylene or poly-a-olefin.

In another aspect of the present invention, in the thermal fuse employing a thermosensitive pellet in which the thermosensitive pellet member containing a polyolefin wax as a main component is used to set the operating temperature within a range of 50 to 180° C., a composition of a crystalline higher a-olefin polymer and a hydrocarbon wax is preferable for the polyolefin wax. Furthermore, it is disclosed that the polyolefin wax is produced using a metallocene catalyst, has a weight average molecular weight within a range of 1,000 to 100,000 (Mw) measured by a gel permeation chromatography (GPC) method, and specifically has a hardness with a rate of penetration in accordance with a measuring method defined in JIS K 2207 being not more than 10. Thus, the thermal fuse employing a thermosensitive pellet allowing the operating temperature to be set within a range of 50 to 180° C. and having an operating temperature in a low temperature region is provided, with the result that a new usage may be developed and its practical effect may be highly evaluated. Furthermore, the polyolefin resin is mixed with the polyolefin wax to thereby allow the molding ability to be improved in the case where the injection molding or the extrusion is applied as a pellet molding method. In this case, it is desirable to select the resin to be mixed from the materials each having a melting point closer to that of the polyolefin wax. Mixing of such a resin allows fine adjustment of the operating temperature.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention provides an irreversible thermal fuse employing a thermosensitive pellet including a metal casing; a pair of lead members having a second lead portion caulked at one end of this metal casing and a first lead portion fixed at the other end of the casing via an insulation bushing; and a switching member housed in the metal casing and having a spring member, a movable conductor and a thermosensitive pellet, in which, an electrical circuit between the pair of lead members is cut off at a prescribed operating temperature by the softening and melting of the thermosensitive material of the thermosensitive pellet. A polyolefin wax is used as a main component for the thermosensitive material, particularly, the wax having a melting point closer to the desired operating temperature is selected to set the operating temperature within a desired range of 50 to 180° C., and thermal deformation of the thermosensitive pellet causes the switching member to be operated for insulation of the circuit. Conventionally, the thermosensitive material for a low temperature region using a paraffin wax as a main component has disadvantages including broad melting temperature characteristics and a difficulty in handling, and accordingly, a practical use thereof becomes difficult in the region having a temperature below approximately 90° C. In this regard, the thermosensitive material of the present invention is used to thereby allow for quick actuation, high accuracy and high reliability even in the case of the thermal fuse employing a thermosensitive pellet having an operating temperature of 50 to 90° C.

Figure 1:
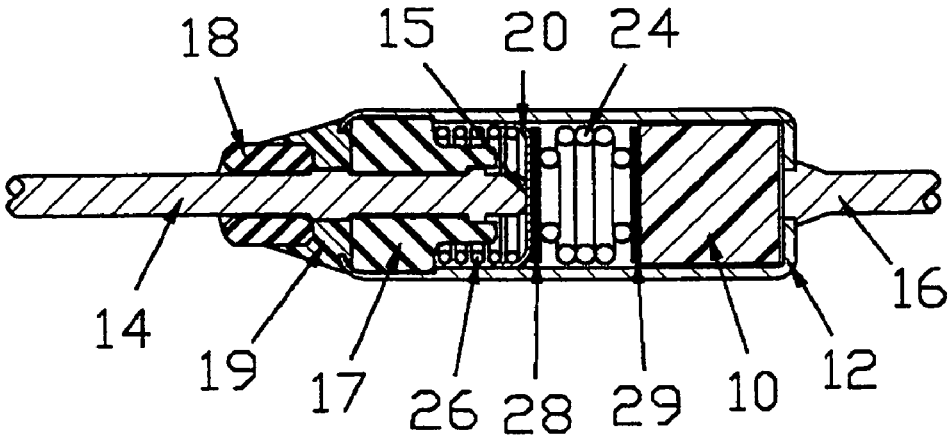
FIG. 1 is a partial cross-sectional view of a thermal fuse employing a thermosensitive pellet of an example according to the present invention in a normal state at normal temperature.

Specifically, as shown in FIG. 1, attached to a metal casing 12 is a pair of lead members having a first lead portion 14 fixed at one opening of metal casing 12 and a second lead portion 16 caulked at the other opening of metal casing 12, and this metal casing 12 houses therein a thermosensitive pellet member 10, a movable conductor 20, and a switching function member (switching movable member) including a spring member having a strong compression spring 24 and a weak compression spring 26, to thereby configure a thermal fuse employing a thermosensitive pellet. The thermal fuse employing a thermosensitive pellet is provided in which thermosensitive pellet member 10 includes a polyolefin wax as a main component of the thermosensitive material and an operating temperature is set with a melting point of 50 to 180° C. and specifically of 90 to 152° C. in examples.

The composition constituting the thermosensitive pellet member is a polyolefin wax mixed with other thermoplastic resin material, preferably the same type of resin as the wax, and added with an additive such as a plasticizer, a rubber material, a filler and an antioxidant, to thereby adjust the operating temperature. Furthermore, while the polyolefin wax is produced by using a Ziegler catalyst or a metallocene catalyst, it has been found that the polyolefin wax produced by using the metallocene catalyst is preferable to that by using the Ziegler catalyst. Examples of a polymer which can be polymerized using the metallocene catalyst are linear low density polyethylene (LLDPE) and polypropylene. The polymer polymerized using the metallocene catalyst is uniform in molecular weight distribution and crystallinity. The polymer includes less low molecular weight component, and for that reason, the polymer has less stickiness and the narrow range of the melting temperature. Examples of a preferable polymer are polyethylene having a melting point of 100 to 140° C. and polypropylene having a melting point of 120 to 175° C. Polypropylene here also includes a random copolymer having a low melting point. Furthermore, it has been found that it is preferable to use, for a polyolefin wax, one type or two or more types of polymers selected from a group consisting of polyethylene, polypropylene and poly-α-olefin. In the case where the above-described polymers are used, the mixing ratio thereof is not particularly limited and the composition including a weight average molecular weight and a hardness described below is preferable.

It is desirable that the polyolefin wax has a weight average molecular weight measured by a gel permeation chromatography (GPC) method falling within a range of 1,000 to 100,000 (Mw). Specifically, the weight average molecular weight corresponds to a value measured by the GPC method at an elution temperature of 140° C. using Alliance GPC2000 manufactured by Waters Corporation as a measuring apparatus, Styragel GPC Column (4.6 mm×300 mm) (HT-3, HT-4 and HT-6E in series) manufactured by Waters Corporation as a column and polystyrene as a molecular weight standard substance sample (manufactured by Shodex Co., molecular weight of 5030, 55100, 696000, 3740000, 1990, 13900, 197000, 2210000). The present invention also provides a thermal fuse employing a thermosensitive pellet made of such a polyolefin wax having a hardness with a rate of penetration in accordance with the measuring method defined in JIS K 2207 being not more than 10. The outline of the testing method for the rate of penetration defined in JIS is such that a sample is heated, melted and placed in a sample container, then the sample is cooled, and kept at a constant temperature in an isothermal water bath, then a specified needle is vertically introduced into the sample having a total mass of 100 g for 5 seconds. The rate of penetration of the needle is represented by a value (absolute number) obtained by measuring the penetration depth of the needle in units of 0.1 mm and multiplying the result by 10.

The thermal fuse of the present invention shows remarkable advantages, such that the thermal fuse is stabilized at the operating temperature in the low temperature region and quickly actuated and the like, by using the polyolefin wax as a thermosensitive material. Even if the thermosensitive pellet member is a conventional member using a crystalline thermoplastic resin as a thermosensitive material, the resin materials vary widely, and in order to select a specific substance therefrom, it is necessary to recognize the characteristics of each material and take the industrial applicability as a thermosensitive pellet into consideration. While the selection is made after much trial and error, the present invention is particularly remarkable as a thermosensitive material in the low temperature region. The operating temperature of the thermal fuse employing a thermosensitive pellet can be finely adjusted by the pressing force of the spring of the spring member of the switching movable member. Accordingly, if the melting point of the thermosensitive material to be used is selected, an operating temperature can be readily set. For example, in the case of using the polyolefin wax, an operating temperature can be arbitrarily determined by the melting point of the polyolefin wax, that is within the range of the extrapolated initial melting temperature (Tim) and the extrapolated ending melting temperature (Tem) of the polyolefin wax. It is experimentally revealed whether the selected polyolefin wax is appropriate or not as a thermosensitive material for a thermal fuse in the present invention, in consideration of the actuation speed and the mechanical physical properties of the selected polyolefin wax.

The prescribed operating temperature is set by selecting the thermal deformation temperature, and can be adjusted within the range of the melting point of the polyolefin wax, that is, within the range of the above-described Tim and Tem. The thermal deformation temperature can be adjusted by changing the weight average molecular weight of the polyolefin wax. According to the present invention, it has been found that the weight average molecular weight can be selected preferably from the range of 1,000 to 100,000 (Mw) thereof, and, more preferably, from the range of 1,000 to 50,000 (Mw) thereof. Furthermore, the thermal deformation temperature can be raised or lowered by adding a plasticizer or a filler to the polyolefin wax. In addition, the supplementary agent includes secondary materials for wax classified into three types including an additive, a reinforcement material and a filler. The additive generally includes an antioxidant, a thermostabilizer, a photostabilizer, a crystal nucleating agent a compatibilizer, a colorant, an antimicrobial agent, an antifungal agent, lubricant, and a foaming agent. The remarkable additives among them include the antioxidant, the thermostabilizer, the crystal nucleating agent by which the degree of crystallinity is increased, and the colorant by which the temperature range is identified. The reinforcement material includes mica, calcium carbonate, glass fiber, rubber material, carbon fiber, aramid fiber and the like, which are added when the thermosensitive pellet in a copolymer or an elastomer softens more than necessary or the physical dimensional stability of the thermosensitive pellet requires to be maintained at high temperature. The filler includes an extender such as talc, clay, and calcium carbonate. The extender is introduced into the wax to minimize the cost for the raw material(s). Furthermore, there are also a flame retarder helping the wax to be less flammable, and an antistatic agent introduced to prevent the wax from storing electricity. Furthermore, the operating temperature can be finely adjusted by adjusting the spring of the switching movable member. The antioxidant can include a phenol type, a phosphorus type, a sulfur type and the like by way of example. The antioxidant in the present invention can also include a heat-resistant stabilizer such as a lactone type, a hydroxylamine type, vitamin E, and a metal deactivator. Particularly, when the phenol type and the sulfur type are added as an antioxidant, the performance of the thermal fuse employing a thermosensitive pellet containing an olefin wax can be improved.

EXAMPLES

Although the present invention will be hereafter described in greater detail in connection with examples, the present invention is not limited thereto.

In the present examples, a thermal fuse employing a thermosensitive pellet having the structure shown in FIG. 1 was manufactured.

Figure 2:
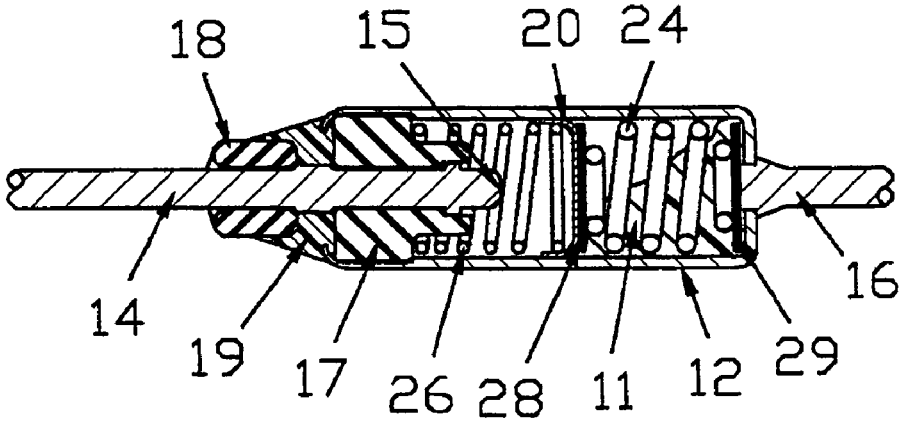
FIG. 2 is a partial cross-sectional view of the thermal fuse employing a thermosensitive pellet of the example according to the present invention after the rise to the abnormal temperature.

FIGS. 1 and 2 each show a thermal fuse employing a thermosensitive pellet of the examples according to the present invention. FIG. 1 is a partial cross-sectional view of the thermal fuse employing a thermosensitive pellet in a normal state at normal temperature, and FIG. 2 is a partial cross-sectional view of the thermal fuse employing a thermosensitive pellet after the rise to the abnormal temperature. As shown in FIG. 1, the thermal fuse employing a thermosensitive pellet according to the present invention is configured such that a thermosensitive pellet member 10 and a switching function member described below are housed in a cylindrical metal casing 12. Metal casing 12 has a pair of lead members attached thereto, in which metal casing 12 has a first lead portion 14 fixed at one opening and a second lead portion 16 caulked at the other opening. First lead portion 14 extends into metal casing 12 through an insulation bushing 17 by which it is insulated from metal casing 12, and has a tip portion 15 formed as a first electrode. First lead portion 14 has an externally guided portion provided with an insulation tube 18 for protection which is fixedly sealed by a sealing resin 19 sealing the opening of metal casing 12. On the other hand, second lead portion 16 is fixed in contact with metal casing 12 directly by caulking, and an inner surface of metal casing 12 itself is formed as a second electrode. The switching function member housed in metal casing 12 includes the above-described thermosensitive pellet member 10, a movable conductor 20 having a central contact with the first electrode and a star-shaped peripheral contact with the second electrode, and a spring member having a strong compression spring 24 and a weak compression spring 26. In the spring member of the strong and weak compression springs at normal temperature, as shown in FIG. 1, strong compression spring 24 acting against the resilience of weak compression spring 26 presses and thus bring movable conductor 20 into contact with the first electrode. In particular, strong compression spring 24 is disposed between thermosensitive pellet member 10 and movable conductor 20 with pressure plates 28 and 29 interposed therebetween to facilitate assembly and also allow the stabilized spring operation. In abnormal condition associated with increased temperature, as shown in FIG. 2, the softened or melted thermosensitive pellet member (thermosensitive pellet member 11 after melting) deforms, causing weak compression spring 26 to exert force to press and thus move movable conductor 20. Strong compression spring 24 has a spring released from its stroke range, and weak compression spring 26 exerts force to push movable conductor 20 within its stroke range, causing movable conductor 20 to slide on the second electrode located at the inner surface of metal casing 12. Movable conductor 20 is thus moved to disconnect movable conductor 20 itself from tip portion 15 of the first electrode, which, in turn, switches off an electrical circuit. Note that the thermal fuse employing a thermosensitive pellet shown in FIGS. 1 and 2 configures an irreversible-type thermal fuse employing a thermosensitive pellet normally being on and turned off for abnormality.

The thermal fuse employing a thermosensitive pellet of the present invention is configured such that a metallic cylindrical casing (metal casing) having a pair of leads attached thereto houses a switching movable member including a movable conductor and a thermosensitive pellet member containing a polyolefin wax as a main component, in which the deformation associated with the softening and melting of the thermosensitive pellet member causes the movable conductor to slide, to thereby attain a cut-off state between the leads within a range of 50 to 180° C. of the prescribed operating temperature. In this case, the thermosensitive pellet member is a synthetic wax chemically synthesized and having a weight average molecular weight of 1,000 to 100,000 (Mw) measured by the gel permeation chromatography (GPC) method. Preferably, the well-known crystalline higher a-olefin polymer or the wax composition containing the same and a hydrocarbon wax can be used, which allows for the thermal fuse employing a thermosensitive pellet having an excellent balance of retentivity, hardness, toughness and the like and presenting improved mechanical physical properties. Note that it is also possible to provide a thermal fuse employing a thermosensitive pellet in which the thermosensitive pellet containing a polyolefin wax as a main component can be used mixed with a different thermoplastic resin and thermoplastic wax, to which an antioxidant and the like are added. In the examples, prototype example products 1-6 using six types of polyolefin waxes were compared with comparative products 1 and 2 using the conventional paraffin wax and polyethylene resin for review. In other words, the thermosensitive pellets were prepared for each product, which were then used to prepare the thermal fuse for comparison and review.

TABLE 1

| | Composition | Weight Average Molecular Weight | Melting Point (° C.) | Hardness (Rate of Penetration) |
|---|---|---|---|---|
| Example Product 1 | Polyethylene Wax (Ziegler-Natta Catalyst) | 2,000 | 122 | 1 |
| Example Product 2 | Polyethylene Wax (Ziegler-Natta Catalyst) | 1,000 | 109 | 25 |
| Example Product 3 | Polyethylene Wax (Ziegler-Natta Catalyst) | 3,000 | 109 | 10 |
| Example Product 4 | Polyethylene Wax (Metallocene Catalyst) | 2,000 | 124 | 1 |
| Example Product 5 | Polyethylene Wax (Metallocene Catalyst) | 4,600 | 90 | 2 |
| Example Product 6 | Polypropylene Wax (Ziegler-Natta Catalyst) | 30,000 | 152 | not more than 1 |
| Comparative Product 1 | Paraffin Wax | 500 | 76 | 23 |
| Comparative Product 2 | Polyethylene Resin (Metallocene Catalyst) | 140,000 | 117 | — |

Table 1 shows the names of the thermosensitive materials and the values of their physical characteristics concerning six types of different polyolefin waxes targeted for review as an example product of the present invention, and a conventional paraffin wax and polyethylene resin, each of which are a comparative product. It is to be noted that the substances produced by using a Ziegler catalyst and a metallocene catalyst are each a polyolefin wax and the utilized catalysts are each listed in parentheses in the column of the main composition in Table 1.

TABLE 2

| | Operating Temperature (° C.) | | | | | ΔT (° C.) | Standard Deviation |
|---|---|---|---|---|---|---|---|
| Example Product 1 | 120.3 | 121.1 | 120.8 | 120.9 | 121.8 | 1.5 | 0.5 |
| Example Product 2 | 107.3 | 108.3 | 108.0 | 107.7 | 107.2 | 1.1 | 0.5 |
| Example Product 3 | 107.9 | 108.7 | 108.5 | 108.4 | 108.2 | 0.8 | 0.3 |
| Example Product 4 | 123.8 | 123.7 | 123.9 | 123.6 | 123.8 | 0.3 | 0.1 |
| Example Product 5 | 90.2 | 90.5 | 90.3 | 90.2 | 89.9 | 0.6 | 0.2 |
| Example Product 6 | 150.3 | 150.2 | 150.8 | 150.9 | 151.2 | 1.0 | 0.4 |
| Comparative Product 1 | 74.3 | 70.6 | 68.9 | 71.2 | 64.2 | 10.1 | 3.7 |
| Comparative Product 2 | 117.7 | 117.6 | 117.5 | 117.8 | 117.9 | 0.4 | 0.2 |

Table 2 shows five respective operating temperatures concerning the thermal fuses produced with the thermosensitive pellets of the example products made of the polyolefin waxes, respectively, shown in Table 1 and the thermal fuses produced using, for the thermosensitive pellets, the conventional products made of the paraffin wax and the polyethylene resin, respectively, each of which are a comparative product shown in Table 1. According to this table, ΔT of the comparative product 1 is as high as 10.1° C. ΔT shows the difference between the highest operating temperature and the lowest operating temperature. In comparison to this, it has been found that the polyolefin wax of the present invention shows ΔT of 2° C. or less in each example product, and thus, provides excellent accuracy in operation.

TABLE 3

| | Immersion Temperature (° C.) | Time Required to Start Operation (sec.) | | | | | Average (sec.) |
|---|---|---|---|---|---|---|---|
| Example Product 1 | 144 | 12.2 | 11.9 | 11.8 | 13.3 | 12.2 | 12.3 |
| Example Product 2 | 129 | 10.6 | 10.9 | 8.9 | 9.3 | 9.7 | 9.9 |
| Example Product 3 | 129 | 12.3 | 12.5 | 11.1 | 11.3 | 11.8 | 11.8 |
| Example Product 4 | 144 | 12.0 | 11.8 | 11.6 | 11.9 | 13.2 | 12.1 |
| Example Product 5 | 110 | 13.3 | 13.2 | 13.8 | 14.1 | 13.5 | 13.6 |
| Example Product 6 | 172 | 15.5 | 15.2 | 16.3 | 16.2 | 16.8 | 16.0 |
| Comparative Product 1 | 96 | 8.6 | 9.3 | 9.2 | 9.5 | 9.7 | 9.3 |
| Comparative Product 2 | 137 | 20.8 | 19.7 | 20.8 | 20.9 | 20.6 | 20.6 |

As in Table 2, Table 3 shows the measured time required for the thermal fuse to start operating from the moment the thermal fuse was immersed in an oil bath, with regard to prototypes of the thermal fuses of the present invention produced using the polyolefin waxes and comparative products of the thermal fuses each produced using the conventional thermosensitive pellet member. Each thermal fuse was immersed in the oil bath having a temperature 20° C. higher than the respective prescribed operating temperatures, and the time from the start of the immersing to the start of the operation (the time required to start the operation, which is also referred to as a response time) was measured. As can be seen from the results in Table 3, it has been found that while each of example products 1 to 6 having the polyolefin wax of the present invention incorporated into the thermosensitive pellet provides the response time inferior to the response speed in the case of the paraffin wax of a comparative product 1, the response time is significantly improved as compared to the case where the polyethylene resin having a molecular weight of 100,000 or more which is a comparative product 2 of a conventional art is used for the thermosensitive pellet member. In this case, the polyolefin wax as a thermosensitive pellet member is apparently different from the polyolefin resin as a material. Further preferably, the weight average molecular weight of the polyolefin wax is selected from within a range of 1,000 to 100,000 (Mw). The response time may be degraded in the case of the weight average molecular weight exceeding 100,000 (Mw), and thus, the upper limit is set to 100,000 (Mw).

TABLE 4

| | Storage Temperature | Number of Disconnection (Number of Disconnection/ Number of Tests) | |
|---|---|---|---|
| | (° C.) | After 3000 Hours | After 5000 Hours |
| Example Product 1 | 112 | 0/10 | 0/10 |
| Example Product 2 | 99 | 2/10 | 10/10 |
| Example Product 3 | 99 | 0/10 | 1/10 |
| Example Product 4 | 114 | 0/10 | 0/10 |
| Example Product 5 | 80 | 0/10 | 0/10 |
| Example Product 6 | 142 | 0/10 | 0/10 |
| Comparative Product 1 | 66 | 10/10 | 10/10 |
| Comparative Product 2 | 107 | 0/10 | 0/10 |

Table 4 shows the result of checking for disconnection after each thermal fuse employing a thermosensitive pellet prepared using the material listed in Table 1 was stored for 3000 hours and 5000 hours at the temperature 10° C. lower than the melting point of the thermosensitive pellet member. The number of tests to be carried out is assumed to be 10. As a result of the tests, after 3000 hours, all ten of the samples of a comparative product 1 were disconnected and two of ten samples of an example product 2 having a hardness of 25 were disconnected. Similarly, after 5000 hours, all of ten samples were disconnected in example product 2 having a hardness of 25 and one of ten samples was disconnected in an example product 3 having a hardness of 10. It has thus been found that, with regard to the characteristics required for the thermosensitive pellet member for the thermal fuse requiring the conditions of use at high temperature, a practical upper limit of the hardness is 10, and therefore, a hardness of 10 or less is preferable.

Furthermore, an antioxidant of, for example, a phenol type, a phosphorus type and a sulfur type may be added to the polyolefin wax of the above-described examples to prevent degradation during use at high temperature, and, a filler and a plasticizer may be added to adjust the operating temperature.

Furthermore, in another aspect, even in the case of the wax, the weight average molecular weight of less than 1,000 (Mw) causes problems concerning moldability, workability, stickiness during the handling thereafter, and the like. On the other hand, the polymer having the molecular weight exceeding 100,000 (Mw) corresponds to a resin, and therefore, is disadvantageous in the improvement of the response time which is the task of the present invention. Therefore, it is preferable that the wax and the resin are mixed to be used, in order to improve the moldability in addition to the response time.

Furthermore, in the case where the operating temperature falls within a relatively low temperature region of the range of 50 to 90° C. which is included in the range of 50 to 180° C., a wax composition of a crystalline higher α-olefin polymer and a hydrocarbon wax can be used as a polyolefin wax for the thermosensitive pellet member.

The polymerization method of the polyolefin wax of the present invention includes methods using a Ziegler catalyst and a metallocene catalyst, respectively. It is preferable to use, as a thermosensitive pellet material for the thermal fuse employing a thermosensitive pellet, a polyolefin wax produced by using the metallocene catalyst which is known for its narrow molecular weight distribution.

It is to be noted that, in the present invention, the polyolefin wax can be selected based on the melting point including the range of 50 to 90° C. This range is otherwise difficult to be covered by the wax derived from a natural product such as a conventional paraffin wax. Therefore, the polyolefin wax achieves significant practical effects.

In the present invention, the thermoplastic resin, preferably the polyolefin resin which is the same type of the polyolefin wax is mixed with the above-described wax, to allow the moldability of the thermosensitive pellet member (10) to be improved. In this case, polyethylene, polypropylene and the like can be used as a polyolefin resin. The mixing ratio of these resins can be adjusted in the range that allows the extrusion and the injection molding for the respective waxes to be mixed.

Five types of examples will then be described in detail, in which a polyethylene wax and a polyethylene resin are mixed in different mixing ratios in the case where the above-described wax and resin are mixed. Table 5 shows mixed materials and six types of different mixing ratios. In this case, a comparative product A is a thermal fuse containing a material constituting a conventional thermosensitive pellet member, and five types of example products B-F each are a thermal fuse containing a material constituting a thermosensitive pellet member in the example of the present invention. Comparative product A using only the polyethylene resin as a thermosensitive material and five types of example products each using one of the thermosensitive materials which were different in composition ratio of the wax and the resin were prepared. These were used to prepare thermal fuses in accordance with the predetermined method as similar to the above-described example products 1-6, and each initial operating temperature thereof was measured. The results are shown in Table 6.

TABLE 5

| | Mixing Ratio (wt %) | | | | | |
|---|---|---|---|---|---|---|
| Mixed Material | Comparative Product A | Example Product B | Example Product C | Example Product D | Example Product E | Example Product F |
| PE Wax | 0 | 20 | 33 | 50 | 67 | 100 |
| PE Resin | 100 | 80 | 67 | 50 | 33 | 0 |

In Table 5, "PE wax" is a polyethylene wax which has a molecular weight of 33,000 Mw and a melting point of 127° C. Furthermore, "PE resin" is a polyethylene resin which has a molecular weight of 265,000 Mw and a melting point of 129° C. In Table 5, the mixing ratio of each material is shown by wt %.

TABLE 6

| Measurement No. | Initial Operating Temperature (° C.) | | | | | |
|---|---|---|---|---|---|---|
| | Comparative Product A | Example Product B | Example Product C | Example Product D | Example Product E | Example Product F |
| 1 | 128.9 | 128.4 | 128.2 | 128.1 | 127.7 | 127.4 |
| 2 | 128.7 | 128.3 | 128.2 | 128.0 | 127.6 | 127.3 |
| 3 | 128.5 | 128.3 | 128.0 | 127.9 | 127.5 | 127.3 |
| 4 | 128.5 | 128.2 | 128.0 | 127.8 | 127.4 | 127.2 |
| 5 | 128.4 | 128.2 | 128.0 | 127.8 | 127.4 | 127.1 |
| Average Value (° C.) | 128.6 | 128.3 | 128.1 | 127.9 | 127.5 | 127.3 |
| Max | 128.9 | 128.4 | 128.2 | 128.1 | 127.7 | 127.4 |
| Min | 128.4 | 128.2 | 128.0 | 127.8 | 127.4 | 127.1 |
| R | 0.5 | 0.2 | 0.2 | 0.3 | 0.3 | 0.3 |

Table 6 shows the results of the five times of measurement of each initial operating temperature of the comparative product and each example product; the average values thereof; maximum values (referred to as Max in Table 6); minimum values (referred to as Min in Table 6); and variations (R=Max−Min). As seen from the results shown in Table 6, regardless of the content ratio of the wax, the initial operating temperature falls within the range of approximately constant variations R, and the content ratio of the wax has no effect on variations R with regard to the operating temperature of the thermal fuse. Thus, it is apparent that high operation accuracy can be ensured in each case. Furthermore, the operating temperature differs depending on the mixing ratio of the wax and the resin which are different in melting point. Accordingly, it has been found that it is efficient, as a way of finely adjusting the operating temperature, to appropriately change the mixing ratio of the wax and the resin which are different in melting point.

Furthermore, with regard to the above-described prepared five types of example products B-F and comparative product A, the response characteristics were measured. Each measurement was made under the condition that each thermal fuse was immersed in the silicone oil at the temperature of 140° C., and the time required to start the operation of the thermal fuse was measured to set a response speed. The results are shown in Table 7. Three thermal fuses were prepared for each of the example products and the comparative product, and each response speed described above was measured to compare the average values.

TABLE 7

| Measurement | Response Speed (sec.) | | | | | |
|---|---|---|---|---|---|---|
| | Comparative Product A | Example Product B | Example Product C | Example Product D | Example Product E | Example Product F |
| 1 | 25.5 | 23.1 | 20.4 | 17.9 | 17.9 | 15.9 |
| 2 | 25.8 | 21.1 | 21.0 | 20.5 | 17.0 | 14.9 |
| 3 | 26.3 | 23.2 | 22.6 | 20.4 | 19.2 | 15.7 |
| Average value (sec.) | 25.9 | 22.5 | 21.3 | 19.6 | 18.0 | 15.5 |
| Max | 26.3 | 23.2 | 22.6 | 20.5 | 19.2 | 15.9 |
| Min | 25.5 | 21.1 | 20.4 | 17.9 | 17.0 | 14.9 |

It has been found from the results in Table 7 that the greater the mixing ratio of the wax is, the more the response speed is increased. Furthermore, it has been confirmed that there is a difference of not less than 10 seconds on average between the response speed of example product F made of 100% of the wax and the response speed of conventional product A made of 100% of the resin.

Accordingly, it has been found from the results of the study that the thermal fuse having a thermosensitive pellet member containing an olefin wax such as a polyethylene wax allows the response speed to be increased while maintaining the operating temperature with high accuracy, as compared to the conventional thermal fuse having a thermosensitive pellet member made of resin.

According to the present invention, since the thermosensitive pellet member contains a polyolefin wax, it can be produced without any operational trouble even in the case of the member having an operating temperature set at approximately 50° C. corresponding to the low temperature region, and thus, a thermal fuse employing a thermosensitive pellet can be provided that is reliably and easily actuated at the prescribed operating temperature. Particularly, in the case where the polyolefin wax is used, the physical properties of the mechanical characteristics are well balanced and an appropriate hardness can be provided. Thus, the disadvantages of the conventional paraffin wax can be eliminated. This causes the resultant thermal fuse to be quickly actuated at the prescribed operating temperature. For example, the thermosensitive pellet member using the crystalline higher a-olefin polymer or the wax composition containing the same and a hydrocarbon wax has sharp melting characteristics as a wax having a low melting point, has an excellent balance of retentivity, hardness and the like of the mechanical characteristics, and thus, can improve the workability in the production process as a thermal fuse employing a thermosensitive pellet and the reliability in the process in which the product is used.

Furthermore, the present invention is secondarily characterized by adding a supplementary agent such as another thermoplastic resin, antioxidant, filler and the like as appropriate to the thermosensitive material containing a polyolefin wax as a main component, and, by adding such a supplementary agent, improves the physical properties of the thermosensitive pellet member. Particularly, it allows the operating temperature to be set within the range of 50 to 90° C. corresponding to the low temperature region. It is also resistant to variation in mechanical characteristics and allows the stabilized and quick actuation, that is, allows the time for actuation to be shortened. Accordingly, the thermal fuse employing a thermosensitive pellet of the present invention is of great value in practical use and improves the reliability.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A thermal fuse employing a thermosensitive pellet comprising at least a switching movable member, a thermosensitive pellet member, a pair of leads including a first lead portion and a second lead portion, and a metal casing, said thermosensitive pellet member containing a polyolefin wax having a weight average molecular weight of 1,000 to 100,000 (Mw) as measured by a gel permeation chromatography (GPC) method, and said thermosensitive pellet member being housed in said metal casing to which said pair of leads are attached, and said switching movable member being operated by deformation associated with softening or melting of said thermosensitive pellet member, to attain a cut-off state between said pair of leads.

2. The thermal fuse employing a thermosensitive pellet according to claim 1, wherein said thermosensitive pellet member is made of a mixed material of said polyolefin wax and a thermoplastic resin.

3. The thermal fuse employing a thermosensitive pellet according to claim 1, wherein said thermosensitive pellet member further contains an antioxidant in addition to said polyolefin wax.

4. The thermal fuse employing a thermosensitive pellet according to claim 1, wherein said thermosensitive pellet member has a melting temperature set within a range of an operating temperature of 50 to 180° C., and said polyolefin wax is made of one type or two or more types of polymers selected from a group consisting of polyethylene, polypropylene and poly-α-olefin.

5. The thermal fuse employing a thermosensitive pellet according to claim 1, wherein said polyolefin wax is made of a composition of a crystalline higher α-olefin polymer and a hydrocarbon wax.

6. The thermal fuse employing a thermosensitive pellet according to claim 1, wherein said polyolefin wax has a hardness with a rate of penetration in accordance with a measuring method defined in JIS K 2207 being not more than 10.

7. The thermal fuse employing a thermosensitive pellet according to claim 1, wherein said thermosensitive pellet member is made of a mixed material of said polyolefin wax and a polyolefin resin.

8. The thermal fuse employing a thermosensitive pellet according to claim 7, wherein said polyolefin wax and said polyolefin resin respectively have melting points that are different from one another.

9. The thermal fuse employing a thermosensitive pellet according to claim 1, wherein said polyolefin wax is made of one of polyethylene, polypropylene, or poly-α-olefin.

10. The thermal fuse employing a thermosensitive pellet according to claim 1, wherein said polyolefin wax is made of at least two of polyethylene, polypropylene and poly-α-olefin.

11. The thermal fuse employing a thermosensitive pellet according to claim 1, wherein said weight average molecular weight of said polyolefin wax is not more than 50,000 (Mw).

12. The thermal fuse employing a thermosensitive pellet according to claim 1, wherein said weight average molecular weight of said polyolefin wax is not more than 30,000 (Mw).

13. The thermal fuse employing a thermosensitive pellet according to claim 1, wherein said thermosensitive pellet member has a melting temperature set within a range of an operating temperature from 50 to 90° C.

14. The thermal fuse employing a thermosensitive pellet according to claim 1, wherein said thermosensitive pellet member has a melting temperature set within a range of an operating temperature from 90 to 152° C.

* * * * *